United States Patent [19]

Bryan

[11] 4,046,347

[45] Sept. 6, 1977

[54] ADAPTOR ASSEMBLY

[75] Inventor: Darold Ray Bryan, Baghdad, Iraq

[73] Assignee: The Boeing Company, Seattle, Wash.

[21] Appl. No.: 723,039

[22] Filed: Sept. 13, 1976

[51] Int. Cl.[2] ..... B65D 19/00

[52] U.S. Cl. ..... 248/346; 108/55.5

[58] Field of Search ..... 248/346; 108/51.1, 55.1, 108/55.5, 56.1, 57.1; 244/118 R, 137 R

[56] References Cited

U.S. PATENT DOCUMENTS

| | | | |
|---|---|---|---|
| 3,029,052 | 4/1962 | Early et al. | 108/57.1 |
| 3,093,092 | 6/1963 | Martin et al. | 108/57.1 X |
| 3,157,423 | 11/1964 | Brie, Sr. | 108/56.1 X |
| 3,212,807 | 10/1965 | Luchford et al. | 108/55.1 X |
| 3,251,489 | 5/1966 | Davidson | 244/137 R X |
| 3,262,588 | 7/1966 | Davidson | 244/137 R X |
| 3,429,536 | 2/1969 | Petry et al. | 248/346 X |
| 3,446,462 | 5/1969 | Brenia | 244/118 R |
| 3,452,958 | 7/1969 | Hambleton | 248/346 |
| 3,509,832 | 5/1970 | Daisley, Jr. | 108/51.1 |
| 3,531,855 | 10/1970 | Spring, Jr. | 108/51.1 X |
| 3,591,121 | 7/1971 | Parris | 248/346 |
| 3,622,114 | 11/1971 | McIntire, Jr. | 108/55.5 X |
| 3,861,541 | 1/1975 | Taft et al. | 244/118 R X |

FOREIGN PATENT DOCUMENTS

| | | | |
|---|---|---|---|
| 781,698 | 8/1957 | United Kingdom | 108/51.1 |

*Primary Examiner*—Roy D. Frazier
*Assistant Examiner*—William E. Lyddane
*Attorney, Agent, or Firm*—Christensen, O'Connor, Garrison & Havelka

[57] ABSTRACT

An adaptor assembly for converting a military cargo pallet for use in a commercial cargo-handling and tiedown system includes two longitudinal frame members and two lateral frame members. The longitudinal frame members are positioned adjacent the sides of a military cargo pallet while the lateral frame members are positioned adjacent the two ends of the cargo pallet. Each of the frame members has a plurality of recesses extending outwardly from their inner sides arranged to receive laterally and longitudinally extending projections on the sides and ends of the military cargo pallet, which projections are utilized for tieing down the military pallet. A second plurality of recesses are spaced at predetermined locations along the length of the longitudinal frame members and extend inwardly from their outer sides and are located and sized to receive an extendable restraining member forming part of a commercial cargo tiedown system. The lateral frame members also have a second plurality of recesses extending into the frame members from their outer sides for use with end tiedown members forming part of a commercial cargo tiedown system. Adjacent ends of the longitudinal and lateral frame members are releasably connected so that the adaptor assembly can easily be attached to a military pallet to convert it for use with a commercial tiedown system and so that it can be easily removed from the pallet to reconvert it for use with a military cargo tiedown system.

10 Claims, 8 Drawing Figures

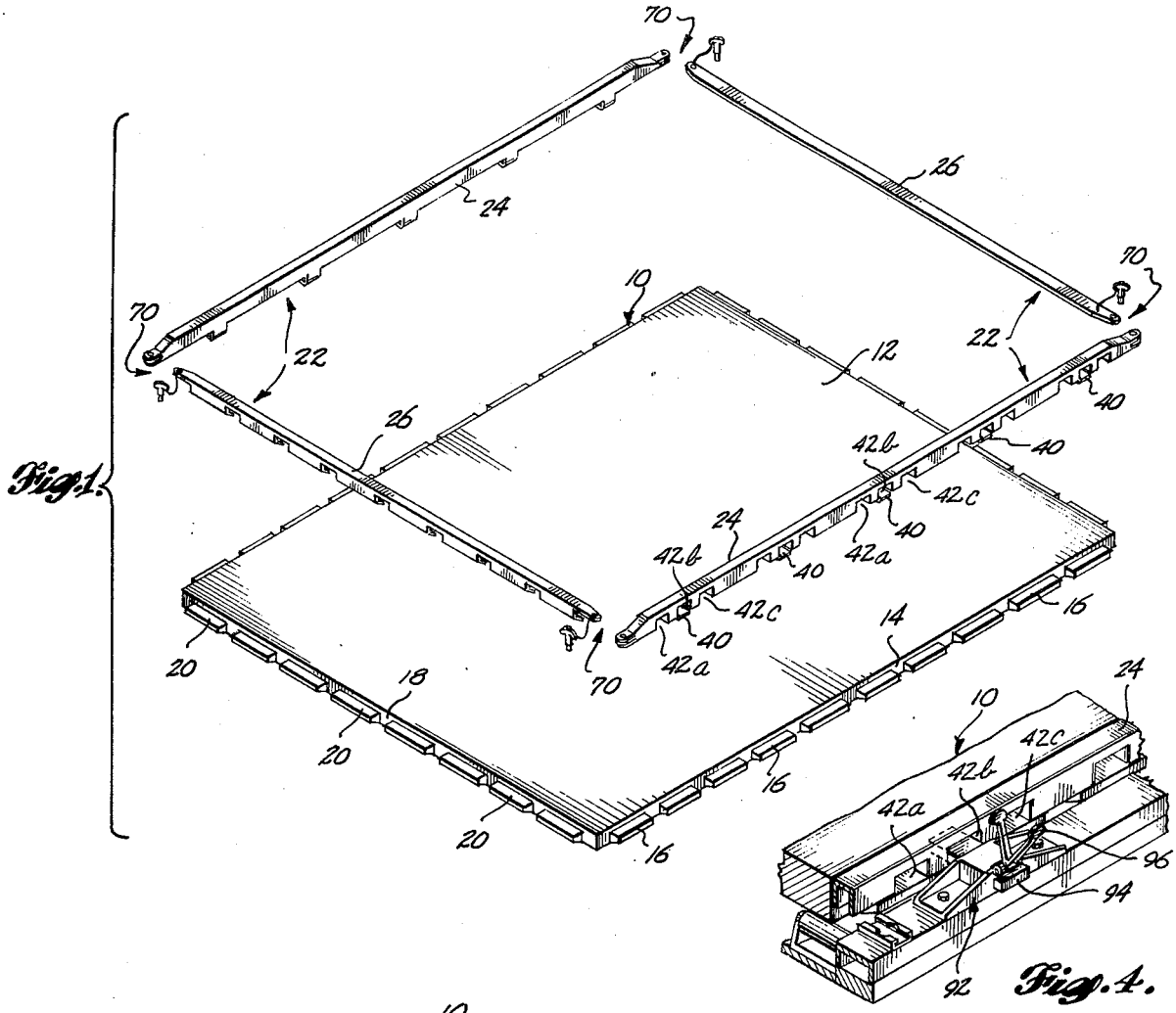
Fig. 1.
Fig. 4.
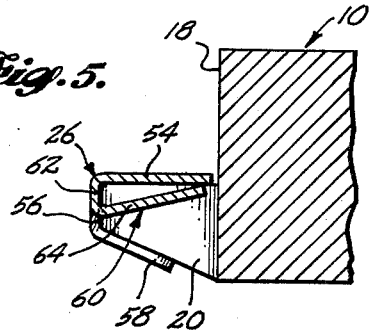
Fig. 5.
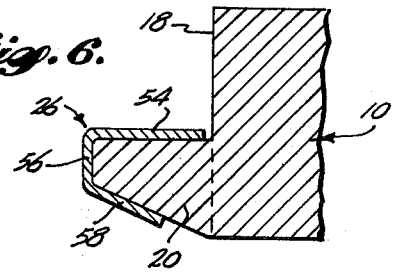
Fig. 6.
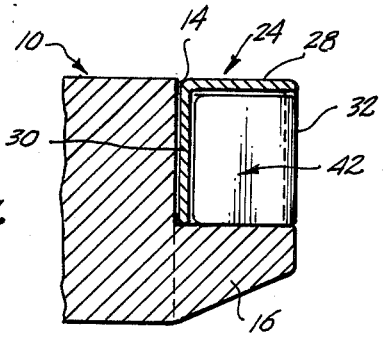
Fig. 7.
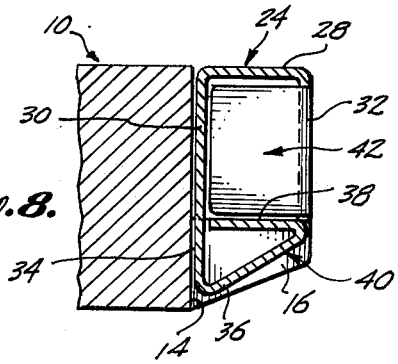
Fig. 8.

ADAPTOR ASSEMBLY

BACKGROUND OF THE INVENTION

The present invention relates to cargo carrying pallets, both platform and container types, normally used in military aircraft cargo-handling and tiedown systems, and more particularly to an adaptor assembly for converting such military pallets for use with commercial, cargo-handling and tiedown systems.

Pallets are normally used for handling cargo onto and off of cargo carrying vehicles such as cargo airplanes. When the term "pallet" is used herein, it includes a basic platform on which cargo is loaded and then tied to the platform as well as enclosed containers into which cargo is loaded. The construction specifications for pallets used in military cargo-handling systems call for base or bottom dimensions of the pallet to be 88 inches in width and 108 inches in length. The specifications also require the military cargo pallets to be fitted with a plurality of lateral projections that extend outwardly from the sides of the pallet adjacent the bottom. These projections are of equal length and are spaced equidistantly along the entire length of the pallet. Similar longitudinal projections are also required on the two ends of the pallet adjacent its bottom. These projections are designed to function with the military tiedown systems used in military cargo aircraft. Such military tiedown systems employ movable retraining members that are locked over and in-between the lateral projections on the sides of the pallets to restrain both longitudinal and vertical movement of the pallets.

On the other hand, commercial pallets are normally 88 inches in width and 125 inches in length. The commercial pallets are provided with a plurality of inwardly extending pockets or recesses, normally having a rectangular cross-section, located adjacent the bottom of the pallet and spaced along the longitudinal sides of the pallet. Similar recesses are also provided along the two ends of the pallet adjacent its bottom. In a commercial cargo-handling system, movable restraining members, in the form of a bar or other movable members that can be slidably inserted into the recesses, are employed to longitudinally and vertically restrain the pallet once it is in place in the aircraft. Normally, end restraining members in commercial cargo-handling systems are fixed at locations along the cargo bed corresponding to the 125 inch length of the commercial pallets. Side restraining members are also positioned on the cargo bed adjacent the sides of the pallet at locations corresponding to one or more of the side recesses in the commercial pallet.

These commercial restraining members are to some extent effective to tie down a military pallet in the commercial cargo-handling system. However, when military pallets are inserted into a commercial cargo-handling and tiedown system, all or a portion of the commercial end restraining members must be repositioned to accommodate and tie down the military pallets. Since repositioning the end restraining members is a time consuming task, only one tiedown member is repositioned for each military pallet, leaving a relatively large space, for example the difference in length between the military pallet and the commercial pallet, between each successive pallet loaded onto the airplane. When the military pallets are inserted in the commercial aircraft tiedown system in this manner, a substantial amount of space is wasted when 15 or so pallets are longitudinally aligned on the aircraft cargo bed. Moreover, if the military pallets are abutted against each other, the commercial side restraining mechanisms will not properly cooperate with the military pallets to individually restrain the military pallets in both the longitudinal and vertical directions.

Another problem with using military pallets in a commercial cargo tiedown system arises when the military pallets are moved into and out of the aircraft cargo bed. Normally, commercial cargo-handling systems employ a plurality of vertically oriented guide rollers that are spaced along the longitudinal dimension of the aircraft. The rollers form side restraining tracks to prevent excessive lateral movement of the pallet as it is being postioned on the cargo bed and moved from the cargo access opening toward the opposite end of the aircraft. The lateral projections on the military pallets tend to catch on the vertical rollers, as they are spaced at distances greater than the spacing of the projections, thus causing the military pallet to sometimes be checked in its movement to or from the access door on the aircraft. This problem could be resolved by adding additional rollers to the lateral restraining tracks in the cargo-handling system, however this solution involves a substantial amount of labor and a relatively high cost, not justified when the cargo-handling system is normally utilized with smooth-sided commercial pallets.

To resolve the foregoing problems, a broad object of the present invention is to provide an apparatus for adapting a military pallet for use in commercial cargo-handling and tiedown systems. Additional objects of the present invention are: to provide an adaptor that is easy to manufacture from metals such as aluminum; to provide an adaptor that is lightweight so that it can be carried on the airplane when not in use; to provide an adaptor that is easily fitted onto a military pallet with only a very small amount of labor; to provide an adaptor that can accommodate both the side and end restraining members normally used in commercial cargo-handling and tiedown systems; to provide an adaptor that has sufficient versatility and adaptability so that military cargo pallets can be placed on a commercial tiedown system with a minimum of lost space between the pallets; and, to provide an adapter that permits military pallets to be placed in a variety of positions in a commercial tiedown system without disturbing the standard commercial positioning and spacing of the commercial side and end restraining members.

Summary of the Invention

In accordance with the foregoing objects and other objects that will become apparent to one of ordinary skill in the art upon reading the following specification, the present invention provides an assembly for adapting a military cargo pallet for use in a commercial cargo-handling and tiedown system. The military cargo pallet has first and second sides, first and second ends and a bottom. The first and second sides of the pallet have a plurality of outwardly extending lateral projections adjacent the bottom of the pallet for use in tieing the pallet down in a military cargo-handling and tiedown system. The adapter assembly comprises first and second longitudinal frame members that are positionable along the sides of the pallet and connecting means associated with the pallet and the longitudinal frame members for securing the latter to the pallet. The inner sides of the longitudinal frame members have a first plurality of recess means for receiving the plurality of lateral projections extending outwardly from the sides of the pallet. The first plurality of recess means is spaced along the inner side of the longitudinal frame members at distances corresponding to the longitudinal spacing of the lateral projections on the pallet. The longitudinal frame members also have second recess means extending laterally into the longitudinal frame members from their outer sides for receiving a movable tiedown member forming a part of the commercial cargo tiedown system. The connecting means further cooperates with the pallet and the longitudinal frame members to prevent them from moving relative to the pallet. In the preferred embodiment, the longitudinal frame members have a number of recesses extending outwardly from the inner side of the frame members that correspond to the number of lateral projections on the side of the military cargo pallet. These recesses are sized so that once the longitudinal frame members have their inner sides abutted against the sides of the pallet, the longitudinal frame members are restrained from moving longitudinally relative to the pallet. Also, in the preferred embodiment of the invention, first and second lateral frame members are abutted against the ends of the pallet. The lateral frame members have recess means extending outwardly from their inner sides for receiving longitudinal projections on the ends of the pallet. The lateral frame members have second recess means extending inwardly from the outer sides thereof for receiving end locking members forming part of a commercial cargo tiedown system. In this preferred embodiment, adjacent ends of the longitudinal and lateral frame members are secured to each other by a removable locking pin. Thus, when the four frame members are positioned about the sides and ends of the military pallet and have their adjacent ends locked to each other, a rigid, rectangular framework is secured to the military pallet. This framework cooperates with the commercial cargo tiedown system to fulfill all of the objects set forth above.

BRIEF DESCRIPTION OF THE DRAWINGS

A better understanding of the present invention can be derived by reading the ensuing specification in conjunction with the accompanying drawings wherein:

FIG. 1 is an exploded isometric view of a military cargo pallet and the adaptor assembly of the present invention;

FIG. 4 is an isometric view of a segment of a side of the military cargo pallet and adaptor assembly of the present invention showing its use with a side and vertical restraining mechanism similar to that normally found in a commercial cargo-handling and tiedown system;

FIG. 5 is a cross-sectional view taken along section line 5—5 of FIG. 3;

FIG. 6 is a cross-sectional view taken along line 6—6 of FIG. 3;

FIG. 7 is a cross-sectional view taken along section line 7—7 of FIG. 3; and FIG. 8 is a cross-sectional view taken along section line 8—8 of FIG. 3.

DETAILED DESCRIPTION

Figures 2, 3:
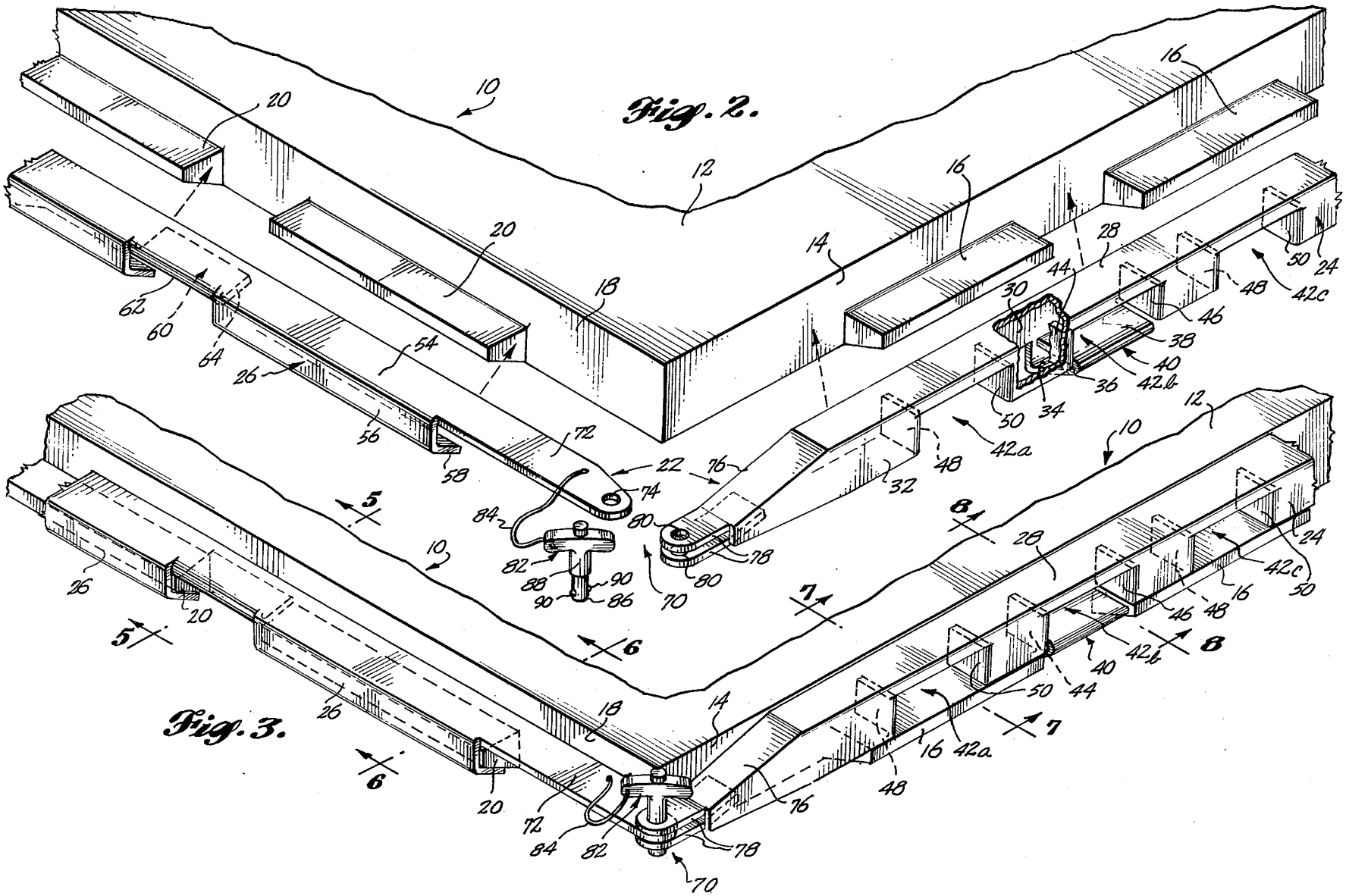
FIG. 2 is a greatly enlarged, exploded, isometric view of a corner segment of a military cargo pallet and adjacent ends of a longitudinal frame member and a lateral frame member.
FIG. 3 is an isometric view similar to that of FIG. 3 showing the adaptor assembly fastened together and locked in place on the military cargo pallet.

Referring first to FIG. 1, a conventional military pallet 10 is rectangularly shaped and has a floor 12 onto which cargo is loaded for movement onto and off of military cargo-handling and tiedown systems such as are used on military airplanes. Cargo pallets of this type are either of a platform configuration having no sides or top, such as that shown in FIG. 1, or can be of the container type having an enclosure mounted on top of the basic platform or formed integrally therewith. When used herein, the term pallet is intended to cover the platform and container type pallets, as well as variations of both these types. Such military pallets have side surfaces 14 (only one of which can be seen in FIG. 1) that are generally vertically oriented and bear a plurality of outwardly extending, lateral projections 16. The later projections 16 have a horizontal top surface, an outer, vertical surface and a downwardly and inwardly extending bottom surface. The sides of the projections are vertical and oriented perpendicularly to the sides of the pallet. The lateral projections are uniformly spaced by predetermined distances in the longitudinal dimension along the side of the pallet 10 and are of equal length. The end surface 18 of the cargo pallet (only one of which can be seen in FIG. 1) bear similarly shaped and sized, longitudinal projections 20 that are equidistantly spaced in the lateral dimension along the lateral, end surfaces of the pallet.

Interlocking devices are provided in military cargo-handling and tiedown systems of the type referred to above that coact with the projections 16 and 20 so that, once the pallets are in position on the aircraft, a portion of the interlocking devices overlies the upper, horizontal surface of the projections 16 and/or 20 and so that a portion of the interlocking device fits between the equally spaced projections. Such interlocking devices restrain the military pallet from moving both in the vertical direction and in the longitudinal direction. Such interlocking devices also abut the side surfaces 14 and/or the end surfaces 18 of the pallet to restrain movement of the pallet in the lateral direction.

Such military pallets, however, are not readily usable with commercial cargo-handling systems, although commercial carriers are often required to haul military cargo in commercial aircraft. In accordance with the present invention, an adapter assembly generally designated 22 (FIG. 1) is provided to fasten onto the military cargo pallet 10 and adapt it for ready use in a commercial cargo-handling and tiedown system without any alteration to the commercial system. The adaptor includes side frames 24 and end frames 26. The side frames are identical to each other and are interchangeable. Likewise, the end frames 26 are identical to and interchangeable with each other.

Referring now conjunctively to FIGS. 1, 2, 3, 7 and 8, each end frame 26 is generally shaped as a hollow, rectangular beam. The generally rectangular configuration of the beam can be fabricated from a generally flat sheet of metal, such as aluminum or steel, that is first cut into a predetermined pattern and then folded along longitudinal fold lines to form the side frame. The side frame 24 has a generally horizontal upper wall 28 and a generally vertical inner wall 30 that extends downwardly from the inside edge of the upper wall. In use, the inwardly facing surface of the inner wall 30 is positioned against the outwardly facing side surface 14 of the pallet 10. The bottom edge of the inner wall 30 terminates at and abuts the upper surface of the lateral projection 16. The outer wall 32 of the side frame 24 is generally vertical and extends downwardly from the outer edge of the upper wall 28 of the side frame. The bottom edge of the outer wall terminates at and abuts the upper horizontal surface of the lateral projections 16 adjacent the outer end of the lateral projection.

At locations along the longitudinal dimension of the side frame 24, the inner wall 30 of the side frame has generally vertical, downward extensions 34, the inner sides of which abut the side 14 of the pallet 10 at a location corresponding to the open space between each of the lateral projections 16. The longitudinal dimension of this downward extension 34 corresponds to the longitudinal spacing between each of the lateral projections 16. That is, the downward extension 34 of the inner wall has a longitudinal dimension or width just slightly less than the longitudinal spacing between each of the lateral projections 16 so that it can easily be moved into and out of the space between the projections while allowing little or no longitudinal movement or no longitudinal movement of the side frame when in place. The vertical height of the downward extension 34 is slightly less than the height of the lateral projection 16 at its base where it joins to the side 14 of the pallet. An outwardly extending interlocking flange generally designated 40, is formed by a bottom wall 36 and an upper wall 38. The bottom wall 36 of the interlocking flange 40 is integral with and extends upwardly and outwardly from the bottom edge of the downward extension 34. The bottom wall 36 of the interlocking flange 40 extends outwardly and upwardly to a location adjacent the outer edge of the lateral projection 16 where it is integrally joined with the upper wall 38 of the interlocking flange. The upper wall 38 extends horizontally inwardly from the location adjacent the outer edge of the lateral projection 16 toward the upper portion of the downward extension 34. The upper surface of the upper wall 38 of the interlocking flange is coplanar with the upper surface of the lateral projection 16 when the side frame 24 is in position on the pallet 10. A plurality of the interlocking flanges 40 are formed on each of the side frames and are spaced along the longitudinal dimension of each of the frames at locations corresponding to the gaps between each of the lateral projections 16 on the pallet 10. Thus when a side frame 24 is properly positioned on the pallet 10, the interlocking flange 40 fit into the spaces between the lateral projections 16 and interlock the side frame 24 with the pallet 10, thus preventing the side frame from moving longitudinally relative to the pallet. Moreover, the pockets or recesses formed between each of the interlocking flanges 40 accommodate the lateral projections 16 so as to envelop the tops and sides of the projections. Since the outer surface of the outer wall 32 of the side frame 24 is spaced outwardly from the side 14 of the pallet 10, no portion of the later projections 16 extends outwardly beyond the outer surface of the outer wall 32 of the side frame. When the side frame is in place, vertically oriented, longitudinally aligned rollers forming part of the lateral guide system of a cargo-handling and tiedown system thus encounter the planar outer wall of the side frames as the pallet is moved along the cargo bed of the cargo-handling and tiedown system. Thus the side frames 14 prevent the lateral projections 16 from interfering with the vertical rollers in the cargo tiedown system.

In addition to the pockets formed by the interlocking flanges 40, a plurality of recesses generally designated 42 are formed in each of the side frames 24. Still referring to FIGS. 1, 2, 3, 7 and 8, these recesses open outwardly onto the outer surface of the outer wall 32 of the side frame 24 and extend inwardly toward the inside surface of the inner wall 30 of the side frame 24. The recesses 42, in the preferred embodiment, are formed in sets of three, which sets are equidistantly spaced along the longitudinal dimension of the side frame 24. The recesses 42 are provided to accommodate a side locking mechanism that forms part of the conventional, commercial cargo-handling and tiedown system for use with which the prevent invention is intended. A description of and the function of the side locking device will be described in greater detail below in conjunction with the description of FIG. 4. The outwardly opening recesses 42 are constructed from tabs originally forming part of the outer wall 32 of the side frame 24. The center recess **42*b* of each set of recesses 42*a*, 42*b* and 42*c* in the preferred embodiment is located directly over an interlocking flange 40. The center recess 42*b* is formed by cutting the outer wall 32 in the vertical direction at about the midpoint of the interlocking flange 40. The vertical split extends upwardly from the bottom edge of the outer wall to a location slightly below the intersection of the outer wall 32 and the upper wall 28. A horizontal cut then extends longitudinally in both directions from the vertical cut to a location directly above the longitudinal ends of the interlocking flange 40, thus forming two tabs 44 and 46. During the construction of the side frame 24 these tabs are bent inwardly and rearwardly about vertical fold lines above the longitudinal edges of the interlocking flange 40 so that the rearward edges of the tabs 44 and 46 are positioned adjacent the inner wall 30 of the side frame 24. Thus the opening of the center recess 42*b* of each of the sets of three recesses 42 is bounded by the upper surface of the interlocking flange 40, the intersecting portions of the tabs 44 and 46 with the outer wall 32 along the vertical fold lines, and the remaining horizontal edge of the outer wall 32 lying above the outer end of the interlocking flange 40. Spaced on either side of the center recess 42*b* of the set of three recesses 42 are secondary recesses 42*a* and 42*c*. The secondary recesses 42*a* and 42*c* are spaced equidistantly on opposite sides of the center one 42*b* of the recesses 42. Each of the secondary recesses 42 is formed in a manner similar to the center recess by cutting the outer wall 32 along a vertical cut line upwardly to a location slightly below the intersection of the outer wall 32 and the upper wall 28, and thereafter forming tabs 48 and 50 by separating the outer wall 32 along a horizontal cut line lying slightly below the intersection of the outer and upper walls of the side frame 24. Thereafter the tabs 48 and 50 are folded forwardly and inwardly about vertical fold lines so that the inner edges of the tabs 48 and 50 lie adjacent the inner surface of the inner wall 30 of the side frame 24**.

Before the side frame 24 is positioned adjacent the side 14 of the pallet 10, the secondary recesses **42*a* and 42*c* not only open outwardly onto the outer surface of the outer wall 32 but also open downwardly relative to the side frame. When the side frame 24 is positioned adjacent the side 14 of the pallet 10 as shown in FIG. 3, the inner surface of the inner wall 30 of the side frame abuts the side 14 of the pallet 10. Each of the interlocking flanges 40 fits between or in the space between the lateral projections 16 on the pallet. In addition, the bottom edges of each of the tabs 44, 46, 48 and 50 abut the upper sufaces of the lateral projections 16. Thus the upper surfaces of the lateral projections 16 form the bottom inside surface of the secondary recesses 42***a* and 42*c* lying adjacent each side of the central recess 42*b* of each of the sets of three recesses 42.

The end frames 26 are constructed somewhat differently from the side frames 24. Referring to FIGS. 1, 2, 3, 5 and 6, the end frame 26 are formed generally in the shape of a U-shaped channel having an upper horizontal wall 54, an outer vertically oriented wall 56 integral with and extending downwardly from the outer portion of the upper wall 54, and a bottom wall 58 integral with and extending generally downwardly and inwardly from the lower edge of the outer wall 56. The inner edge of the upper wall 54 lies adjacent the intersection of the upper surface of the longitudinal projections 20 and the vertical end 18 of the pallet 10. When an end frame is in position on the pallet 10, the lower surface of the upper wall 54 lies on the upper horizontal surfaces of the longitudinal projections 20, and the inner surface of the outer wall 56 abuts the vertical outer surface of the longitudinal projections 20. The bottom wall 58 of the end frame 26 is angled downwardly and inwardly at an angle corresponding to the angle of the bottom surface of the longitudinal projections 20 so that the inner surface of the bottom wall 58 can abut the bottom surface of those projections. The outer and bottom walls of the end frame 26 are modified at each of the locations corresponding to the spaces or gaps between the longitudinal projections 20 to provide inwardly extending interlocking flanges, generally designated 60, that are interposed between each of the longitudinal projections 20 to prevent sideward or lateral mvement of the end frame 26 when it is in position on the pallet 10. The inwardly extending interlocking flanges 60 are formed in the preferred embodiment by cutting the bottom and outer walls 58 and 56 from the inner end of the bottom wall 58 outwardly and upwardly to a location adjacent the intersection of the outer wall 56 and the upper wall 54. These cuts lie in a vertical plane, which vertical plane lies adjacent to the ends of each of the longitudinal projections 20 when the end frame 26 is positioned on the pallet 20. In the preferred embodiment, the interlocking flanges 60 are then formed by folding the tab lying between each of the projections 20 inwardly and upwardly along a horizontal fold line lying approximately halfway along the height of the outer wall 56 of the end frame 26. Thus the inwardly extending interlocking flanges 60 have an outer wall portion 62 that is integral with and extends downwardly from the upper wall 54 and a bottom wall 64 that is integral with and extends rearwardly and slightly upwardly from the bottom edge of the outer wall portion 62. The inner edge of the inwardly extending interlocking flanges 60 terminates adjacent the end 18 of the pallet 10 when the end frame 26 is in position and immediately below the bottom surface of the upper wall 54 of the end frame 26. Thus when the end frame 26 is in position adjacent the end 18 of the pallet 10, the side frame 24 is restrained from moving laterally relative to the pallet by the inwardly extending interlocking flanges 60 and is prevented from moving in an upward and downward direction via the abutting nature of the upper wall 54 and the lower wall 58 on the upper and lower surfaces, respectively, of the longitudinal projections 20.

Each of the ends of the side and end frames are provided with an interconnecting coupling assembly, generally designated 70, that joins the two side frames 24 and the two end frames 26 into a unitary structure when positioned on the pallet 10. Referring to FIGS. 2 and 3, each end of the upper wall 54 of the end frames 26 has a laterally projecting extension 72 that extends slightly beyond the lateral dimension of the pallet 10. The extensions 72 are generally horizontally oriented and have a vertical bore 74 in their outer ends. Likewise, each of the longitudinal ends of the side frames 24 carry extensions 76 that extend slightly beyond the ends 18 of the pallet 10. The longitudinal extensions 76 are formed separately from the rest of the frame 24 and include two horiziontal flanges 78 that are vertically spaced from each other to form a yoke. The horizontal flanges 78 have mutually aligned, vertical bores 80 that correspond in size to the bore 74 in the extensions 72 of the end frame 26. When the side frames and the end frames are positioned on the pallet 10 (as shown in FIG. 3), the vertical bores 80 in each yoke are aligned with the vertical bore 74 in each adjacent lateral extension 72 on the end frames. A coupling pin 82 is inserted through the bores to interlock adjacent ends of the side and end frames 24 and 26.

In the preferred embodiment, a yoke is formed on each of the ends of the side frames 24 and a mating flange is formed on lateral projections on each end of the frames 26. In this manner, the end frames as well as the side frames are interchangeable from one end of the pallet to another and from one side of the pallet to another, as the case may be. To prevent loss of the vertical locking pins 82, they are connected by a flexible cord 84 to the end frames 26. The pin 82 is of the self-locking type having a reduced diameter portion 86 that is insertable into the bores 74 and 80 in the end extensions of the side and end frames and an upper increased diameter portion 88. The annular shoulder between the two portions 86 and 88 forms a stop that abuts with the upper surface of the yoke formed on the side frame extension. Spring biased ball locks 90 mounted in radial bores adjacent the bottom of the reduced diameter portion of the pin secure the pin in connecting relationship with the yoke, and retract into the radial bores upon exerting an upward pull on the locking pins 82. Thus the pins are held securely in place when necessary, but can easily be removed by a workman when the adaptor assembly 22 is to be removed from the pallet 10.

Thus, the adaptor when in place on the pallet (as depicted in FIG. 3) forms an integral assembly that is firmly secured to the pallet. The adaptor is so interlocked with the projections 16 and 20 that the adaptor assembly cannot move laterally, longitudinally or vertically relative to the pallet. Not only does the interlocked nature of the side and end frames 24 and 26 prevent longitudinal movement of the side frames, but the cooperation of the longitudinal projections in the side frame with the outwardly extending interlocking fanges 40 also contribute to the longitudinal restraint. In a similar manner, the interlocking nature of the side frames with the end frames prevent the end frames 26 from moving laterally relative to the pallet while the cooperation of the lateral projections with the inwardly extending interlocking flanges 60 also contribute to the lateral restraint on the end frames 26. Vertical restraint on the pallet 10 is provided by the upper walls of the end frames and the bottom edges of the tabs 44, 46, 48 and 50 resting respectively on the upper surfaces of the longitudinal and lateral projections 20 and 16. In addition, the adaptor assembly is restrained from moving in an upward direction relative to the pallet by the bottom wall 58 of the end frame members.

Referring to FIG. 4, a simplified side locking restraint mechanism normally used with a commercial cargo-handling and tiedown system is illustrated. The side locking restraint mechanism generally designated 92 employs a laterally reciprocable interlocking bar 94 that can be reciprocated laterally by movement of an actuating lever 96. The actuating assembly for the restraint mechanism is not shown, as it exists in the prior art and does not form a part of the present invention. As shown, the laterally reciprocable interlocking bar extends into the central one 42*b* of three recesses 42*a*, 42*b* and 42*c* forming one set of the plurality of sets of recesses spaced along the longitudinal dimension of the side frame 20. Thus the pallet is restrained by the side locking restraint mechanism 92 from movement in both a longitudinal direction and in a vertical direction. When the reciprocable interlocking bar is inserted in the center one 42*b* of the recesses, the side frame 24 prevents longitudinal movement of the pallet since the edges of the reciprocable interlocking bar 94 contact the tabs 44 and 46. Likewise, the bottom surface of the reciprocable interlocking bar 94 abuts the upper surface of the upper wall of the outwardly extending interlocking flange 40 to prevent upward movement of the side frame 24 and thus the pallet 10 relative to the cargo-handling and tiedown system. Although the side recesses 42*a* and 42*c* do not have a bottom, their interrelationship with the lateral projections 16 provides a vertical restraint surface when the reciprocable interlocking bar 94 is inserted into the side recesses. Thus, regardless of the longitudinal dimension of the military pallet 10, the plurality of recesses 42 provide the capability to position the pallet at any one of a variety of locations without readjusting or repositioning the side locking restraint mechanisms 92 in the commercial cargo-handling and tiedown system.

The preferred embodiment of the invention fulfills the objectives set forth above. The simple nature of the side and end frames and their interrelationship with the lateral and longitudinal projections on the military pallet allows them to be installed before or after the pallet is loaded. In addition, the interconnecting coupling assembly for interlocking the side and end frames provides for easy and rapid installation and removal of the adaptor assembly. Since each of the side frames are identical and in their preferred embodiment are symmetrical about a vertical center plane, the side frames are interchangeable; therefore, there is no need to match parts of a given adaptor assembly. Likewise, the end frames are symmetrical about a vertical center plane and can be interchanged between the forward and aft ends of a pallet. Even though the adaptor assembly is constructed of a relatively heavy structural material such as steel, its design still permits a lightweight structure on the order of 50 pounds. If constructed from a lightweight structural material such as aluminum, the weight of the entire adaptor assembly can be reduced to on the order of 18 pounds. Since the adaptor assembly can be broken down into four pieces, it can easily be stored and transported in a cargo aircraft when not in use. Moreover, the adapter assembly allows the military pallet to be either side locked or end locked as required. Because the adaptor assembly is provided with a plurality of sets of side locking recesses, a random intermix of both military and commercial cargo pallets can be fitted into a commercial cargo-handling and tiedown system with a minimum loss of space regardless of the sequential positioning of the two types of pallets.

The foregoing description and advantages of the invention has been set forth in relation to a preferred embodiment. One of ordinary skill after reading the foregoing specification, can effect various alterations, substitutions of equivalents, and changes in the adaptor assembly without departing from the disclosed concepts. It is therefore intended that the projection granted by Letters Patent hereon be limited only by the definition contained in the appended claims and equivalents thereof.

What is claimed is:

1. An adaptor for use with a cargo pallet having first and second sides, first and second ends, and a bottom, said first and second sides having a plurality of outwardly extending, lateral projections thereon adjacent said bottom for use in tieing said pallet down in a first cargo tiedown system, said adaptor for removable interconnection with said pallet for use in tieing said pallet down in a second cargo tiedown system, said adapter comprising:

first and second longitudinal frame members each having an inner side and an outer side, each said longitudinal frame member being positionable adjacent a respective side of said pallet and having a first plurality of recess means on the inner side thereof for receiving said plurality of lateral projections on said pallet, said first plurality of recess means being spaced along the inner side of each said longitudinal frame member at distances corresponding to the longitudinal spacing of said lateral projections on said pallet, each said longitudinal frame member having second recess means extending laterally into said longitudinal frame member from the outer side thereof for receiving a movable tiedown member forming part of said second cargo tiedown system, and connecting means associated with said pallet and said first and second longitudinal frame members for securing said first longitudinal frame member to said pallet, for securing said second longitudinal frame member to said pallet, and for cooperating with said pallet and said longitudinal frame members to prevent longitudinal and lateral movement of said first and second longitudinal frame members relative to said pallet.

2. The adaptor of claim 1 wherein said second recess means on each of said first and second longitudinal frame members comprises:

a plurality of sets of recesses extending laterally into said first and second longitudinal frame members and opening onto the outer surface thereof, each of said sets of recesses being serially spaced in the longitudinal dimension along said frame members at a predetermined distance from the next adjacent one of said sets of recesses, each of said sets of recesses including a plurality of recesses spaced equidistantly from adjacent ones of said recesses within each of said set of recesses.

3. The adaptor of claim 2 wherein each of said sets of recesses comprises three of said recesses.

4. The adaptor of claim 1 wherein said first plurality of recess means in said first and second longitudinal frame members cooperate with said lateral projections to prevent longitudinal movement of said first and second longitudinal frame members relative to said pallet.

5. The adaptor of claim 1 wherein said lateral projections are located on the sides of said pallet adjacent the bottom thereof, wherein said first and second longitudinal frame members each have a top and a bottom, and wherein each said first plurality of recess means is located adjacent the respective bottoms of said first and second longitudinal frame members and each said second recess means is located adjacent the respective tops of said first and second longitudinal frame members.

6. The adaptor of claim 5 wherein a portion of said second recess means on each of said longitudinal frame members overlies a portion of said first plurality of recess means on respective ones of said longitudinal frame members.

7. The adaptor of claim 1 wherein the first and second ends of said pallet have a plurality of outwardly extending longitudinal projections thereon adjacent the bottom of said pallet for use in a first cargo tiedown system, said connecting means comprising:

first and second lateral frame members each having an inner side and an outer side, each said lateral frame member being positionable adjacent a respective end of said pallet and having a first plurality of recess means on the inner side thereof for receiving the longitudinal projections on the respective end of said pallet, said first plurality of recess means being spaced at distances corresponding to the lateral spacng of said longitudinal projections on said pallet, each said lateral frame member having second recess means extending into said lateral frame member from the outer side thereof for receiving a tiedown member forming a part of said second tiedown system, and wherein said connecting means includes locking means for interconnecting each of the ends of said first and second lateral frame members with adjacent ends of said first and second longitudinal frame members.

8. The adaptor of claim 7 wherein the inner sides of said first and second lateral frame members abut the respective ends of said pallet.

9. The adaptor of claim 8 wherein the first and second longitudinal frame members are coextensive with the longitudinal dimension of the respective sides of said pallet and have end portions extending in mutually opposite directions beyond opposite ends of said pallet, and wherein said first and second lateral frame members are coextensive with the lateral dimension of the respective ends of said pallet and have end portions extending in mutually opposing directions beyond opposite sides of said pallet, each of the end portions of said first and second lateral frame members being positioned adjacent an end portion of said first and second longitudinal frame members, said locking means interconnecting the ends of said first and second longitudinal frame members to said first and second lateral frame members.

10. The adaptor of claim 9 wherein each of the adjacent end portions of said first and second longitudinal frame members and said first and second laterally extending frame members comprises:

a yoke and flange engageable between the arms of said yoke, each of the yoke and flange pairs being oriented to be interengageable upon sideward movement of said frame members into adapting relationship with said pallet, each of said yoke and flange pairs having mutually aligned bores oriented in an upright direction, said locking means comprising a connecting pin associated with each of said yoke and flange pairs and being engageable with the mutually aligned bores for removably interlocking said yoke and flange pairs.

* * * * *

UNITED STATES PATENT AND TRADEMARK OFFICE

CERTIFICATE OF CORRECTION

PATENT NO. : 4,046,347

DATED : September 6, 1977

INVENTOR(S) : Darold Ray Bryan

It is certified that error appears in the above-identified patent and that said Letters Patent are hereby corrected as shown below:

Column 11, line 25: delete "spacng" and insert therefor —spacing—.

Column 12, lines 21 and 22: delete the phrase "laterally extending" and insert therefor —lateral—.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*